US007128522B2

(12) United States Patent
Jutras

(10) Patent No.: US 7,128,522 B2
(45) Date of Patent: Oct. 31, 2006

(54) LEAKAGE CONTROL IN A GAS TURBINE ENGINE

(75) Inventor: Martin Jutras, Montreal (CA)

(73) Assignee: Pratt & Whitney Canada Corp., Longueuil (CA)

( * ) Notice: Subject to any disclaimer, the term of this patent is extended or adjusted under 35 U.S.C. 154(b) by 287 days.

(21) Appl. No.: 10/693,961

(22) Filed: Oct. 28, 2003

(65) Prior Publication Data

US 2005/0089398 A1 Apr. 28, 2005

(51) Int. Cl.
*F01D 11/08* (2006.01)

(52) U.S. Cl. ..... 415/1; 415/139; 415/173.1; 415/173.3; 277/359; 277/931; 29/407.01; 29/557; 29/889.22

(58) Field of Classification Search ..... 415/1, 415/135, 136, 138, 139, 173.1, 173.3; 416/1, 416/190, 191; 277/359, 931; 60/799, 800; 29/407.01, 557, 889.21, 889.22
See application file for complete search history.

(56) References Cited

U.S. PATENT DOCUMENTS

| | | | | |
|---|---|---|---|---|
| 3,752,598 | A | 8/1973 | Bowers et al. | |
| 3,801,220 | A | 4/1974 | Beckershoff | |
| 3,970,318 | A | 7/1976 | Tuley | |
| 4,385,864 | A | 5/1983 | Zacherl | |
| 5,004,402 | A | 4/1991 | Burchette et al. | |
| 5,154,581 | A | 10/1992 | Borufka et al. | |
| 5,275,422 | A | 1/1994 | Rehfeld | |
| 5,423,659 | A | 6/1995 | Thompson | |
| 6,065,754 | A | 5/2000 | Cromer et al. | |
| 6,142,731 | A | 11/2000 | Dewis et al. | |
| 6,270,311 | B1 | 8/2001 | Kuwabara et al. | |
| 6,406,256 | B1 | 6/2002 | Marx | |
| 6,910,854 | B1 * | 6/2005 | Joslin | 415/139 |
| 2003/0047878 | A1 | 3/2003 | Bolms et al. | |

FOREIGN PATENT DOCUMENTS

| | | |
|---|---|---|
| EP | 0 058 532 A2 | 8/1982 |
| WO | WO 00/70192 A1 | 11/2000 |

* cited by examiner

*Primary Examiner*—Christopher Verdier
(74) *Attorney, Agent, or Firm*—Ogilvy Renault

(57) ABSTRACT

A gas turbine engine expansion joint comprises first and second members having confronting faces defining a gap therebetween. At room temperature, the gap varies in accordance with the temperature distribution profile of the first and second members during normal engine operation.

24 Claims, 5 Drawing Sheets

LEAKAGE CONTROL IN A GAS TURBINE ENGINE

BACKGROUND OF THE INVENTION

1. Field of the Invention

The present invention relates generally to gas turbine engines and, more particularly, to improved leakage control in gas turbine engines.

2. Description of the Prior Art

Conventional gas turbine shroud segments are manufactured as a full ring and later straight-cut into segments to provide joints which allow for thermal growth. The intersegment gap is typically minimized at the highest power settings, when the segments are at their maximum operating temperature and thus greatest length due to thermal expansion. At lower power, the segments do not expand as much and the gaps do not close down and thus seals are typically required. When seals (e.g. feather seals) are not used, these gaps become the prime leak path for shroud cooling air, which is thermodynamically expensive. It is therefore important to minimize the gaps.

As shown in FIG. 1*a*, the opposed ends of each conventional shroud segment 5 are straight cut to provide parallel mating faces 7 between adjacent segments 5. At room temperature each pair of adjacent shroud segments 5 defines a gap 7. In operation, the shroud segments 5 do not have uniform temperature distribution (the upstream side of the shroud segments 5 is typically exposed to higher temperature than the downstream side thereof). As shown in FIG. 1*b*, this causes non-uniform thermal expansion and thus non-optimized intersegment gaps in operating conditions. The shroud segments 5 will be hotter upstream and cooler downstream of the gas path, which makes the thermal expansion uneven and creates a larger gap on the downstream side where air can escape the cavity defined about the shroud segments 5. As shown in FIG. 1*b*, the high thermal expansion will reduce the gap on the upstream side of the shroud segments 5, whereas the low thermal expansion will leave a larger gap on the downstream side of the segments 5.

SUMMARY OF THE INVENTION

It is therefore an aim of the present invention to provide an improved shroud for a gas turbine engine members.

Therefore, in accordance with one aspect of the present invention, there is provided a gas turbine engine expansion joint, the expansion joint comprising first and second members having confronting faces defining a gap therebetween, wherein, at room temperature, the gap varies from one end of the faces to another end thereof in accordance with the temperature distribution profile of the first and second members during normal engine operation.

In accordance with a further general aspect of the present invention, there is provided a gas turbine engine expansion joint having first and second members, the first and second members being provided with confronting faces defining a gap, which, at room temperature, varies from one end to another as a function of a temperature gradient of said members under engine operating conditions, and wherein said gap is substantially uniform when said first and second members are subject to said engine operating conditions.

In accordance with a further general aspect of the present invention, there is provided a gas turbine engine expansion joint having first and second members, the first and second members being provided with confronting faces defining a gap, the confronting faces being non-parallel at room temperature and substantially parallel under conditions of operating temperatures.

In accordance with a further general aspect of the present invention, there is provided an annular shroud adapted to surround an array of turbine blades of a gas turbine engine, the shroud including a plurality of segments, each pair of adjacent segments having confronting faces defining an intersegment gap therebetween. At room temperature, the intersegment gap varies along a length thereof according to a temperature profile of the segments during normal engine operating conditions.

In accordance with a still further general aspect of the present invention, there is provided a method for controlling leakage of fluid between first and second gas turbine engine members subject to non-uniform thermal growth during engine operation, the first and second members having adjacent ends defining a gap therebetween, the method comprising the steps of: a) establishing a temperature distribution profile of the members along the adjacent ends thereof during normal engine operation, and b) configuring one of the adjacent ends in accordance with the temperature distribution profile obtained in step a).

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1B:
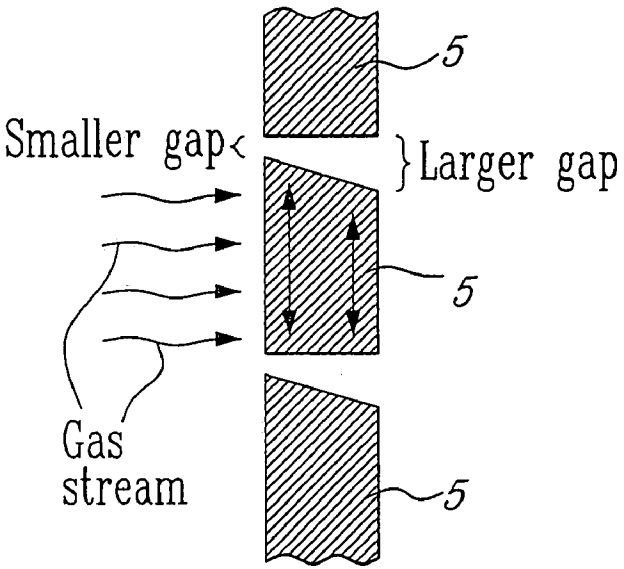
FIG. 1B PRIOR ART
FIGS. 1*a* and 1*b* are enlarged schematic side views of a number of shroud segments forming part of an annular shroud adapted to surround a stage of turbine blade of a gas turbine engine.
Figure 1A:
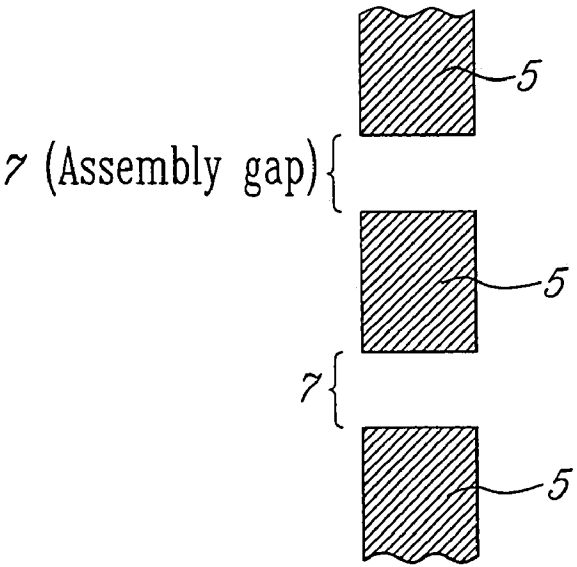
FIG. 1A PRIOR ART
Figure 2:
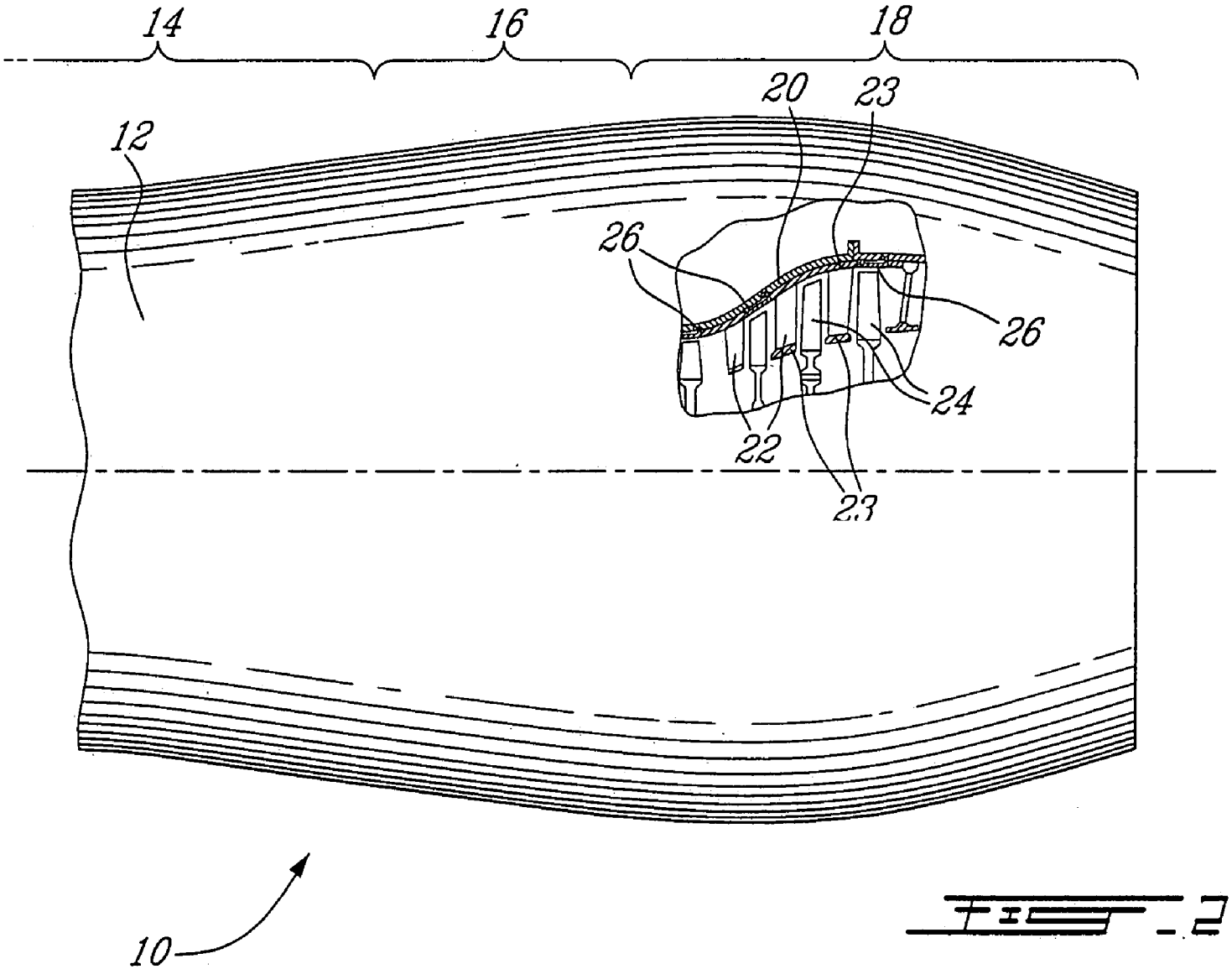
FIG. 2 is an enlarged simplified elevation view of a gas turbine engine with a portion of an engine case broken away to show the internal structures of a turbine section in which an annular segmented shroud is used in accordance with a preferred embodiment of the present invention.

Referring to FIG. 2, there is shown a gas turbine engine 10 enclosed in an engine case 12. The gas turbine engine 10 is of a type preferably provided for use in subsonic flight and comprises a compressor section 14, a combustor section 16 and a turbine section 18. Air flows axially through the compressor section 14, where it is compressed. The compressed air is then mixed with fuel and burned in the combustor section 16 before being expanded in the turbine section 18 to cause the turbine to rotate and, thus, drive the compressor section 14.

The turbine section 18 comprises a turbine support case 20 secured to the engine case 12. The turbine support case 20 encloses alternate stages of stator vanes 22 and rotor blades 24 extending across the flow of combustion gases emanating from the combustor section 16. Each stage of rotor blades 24 is mounted for rotation on a conventional rotor disc 25 (see FIG. 3). Each stage of vanes 22 has inner and outer platforms 23. Disposed radially outwardly of each stage of rotor blades 24 is a circumferentially adjacent annular shroud 26.

Figure 3:
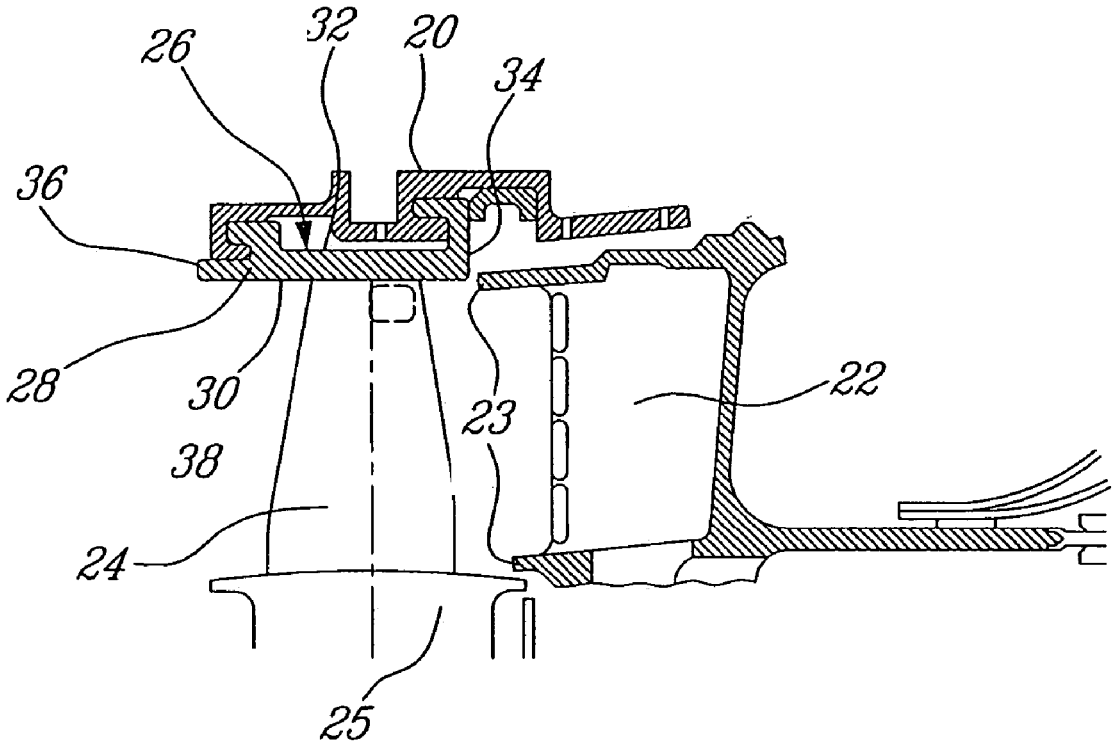
FIG. 3 is a side cross-section view of a first stage turbine assembly and the turbine shroud of the gas turbine engine shown in FIG. 2.
Figure 6:
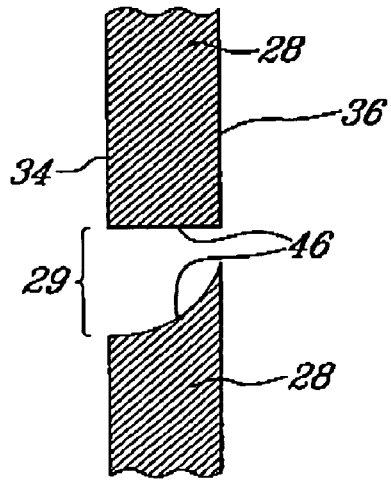
FIG. 6 is a simplified enlarged side view of the shroud segments illustrating the bowed profile thereof when the engine is not operated.

Referring now to FIG. 3, the turbine shroud 26 is disposed radially outward of the plurality of rotor blades 24. The turbine shroud 26 includes a plurality of circumferentially adjacent segments 28 (only one of which is shown in FIG. 3), each pair of adjacent segments 28 providing an expansion joint. More particularly, each pair of adjacent segments 28 defines and intersegment gap 29 (see FIGS. 4*a* and 4*b* and FIG. 6) to provide for the radial expansion and contraction of the turbine shroud 26 during normal engine operation. The segments 28 form an annular ring having a hot gas flow surface 30 (i.e. the radially inner surface of the segments) in radial proximity to the radially outer tips of the plurality of rotor blades 24 and a radially outer surface 32 against which cooling air is directed to cool the shroud 26. Each segment 28 has axially spaced-apart upstream and downstream sides 34 and 36.

The hot air which flows generally axially along the radially inner surface 30 of the shroud 26, as depicted by arrows 38, cools down as it travels from the upstream side 34 to the downstream side 36 of the shroud 26, thereby causing the upstream side 34 of the shroud segments 28 to expand more than the downstream end 36 thereof, as the latter is exposed to lower temperatures. This is represented by arrows 40 and 42 in FIG. 4*b*, arrow 40 representing the thermal growth of the upstream side 34 of the shroud segments 28, whereas arrow 42 represents the thermal growth of the downstream side 36 of the segments 28.

Figure 4B:
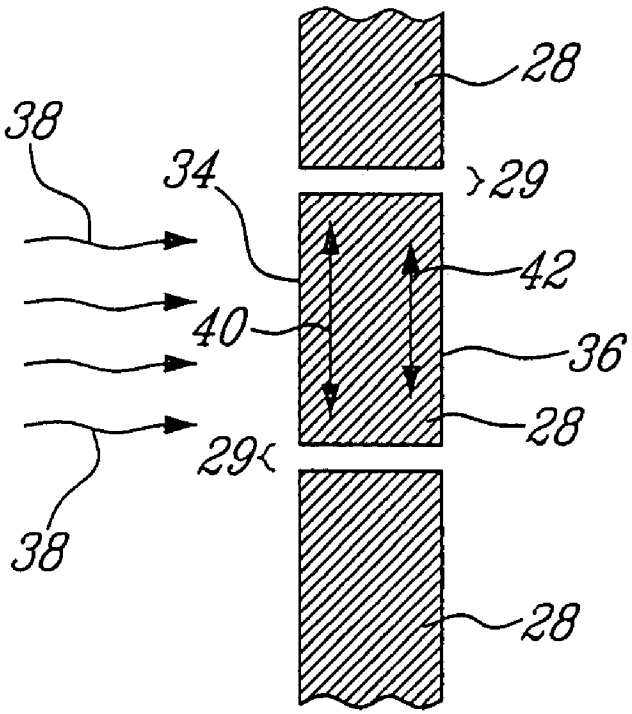
FIGS. 4*a* and 4*b* are simplified enlarged side views of the shroud segments respectively illustrating the intersegment gaps at rest, i.e. when the engine is not operated, and during normal operating conditions
Figure 4A:
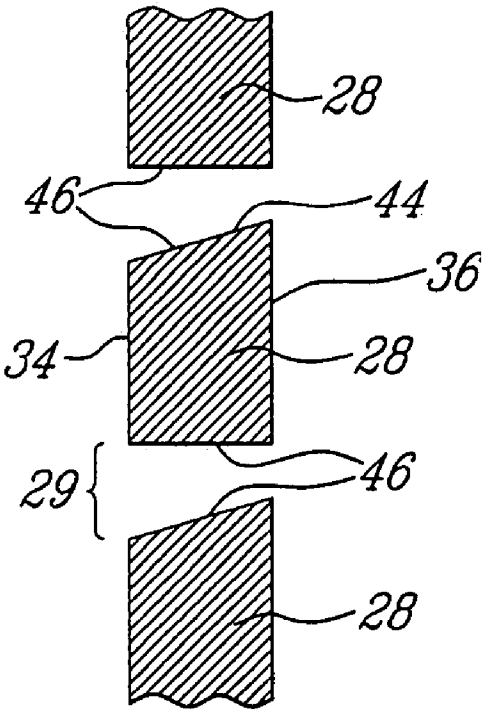

To compensate for said non-uniform expansion of the segments 28 and thus provides for uniform intersegment gaps during :engine operation, it is herein proposed, as shown in FIG. 4*a*, to machine one end of the shroud segments 28 at an angle so that the intersegment gaps 29 close uniformly in operating conditions, thereby leaving a smaller gap and, thus, reducing leakage that would otherwise negatively affect the performances of the engine 10.

As shown in FIG. 4*a*, one end 44 of each shroud segment 28 is cut slantwise at an angle determined by the thermal expansion gradient observed between the upstream side 34 and downstream side 36 of the shroud segments 28. This provides for non-parallel confronting faces 46 at room temperature so that, when the engine 10 is not operated, each intersegment gap 29 is greater on the upstream side 34 than on the downstream side 36 of the shroud 26. However, during engine operation, the upstream side 34 expands more than the downstream side 36, thereby bringing the confronting faces 46 in parallel to one another while the gap 29 is being closed as a result of the expansion of the shroud segments 28. The gaps 29 need not be sized to obtain exactly parallel confronting faces 46 during engine operating conditions, but rather any desired margin may be left to account for preference in design, etc.

The angled cut at the end 44 (FIG. 4*a*) thus allows to compensate for the axially uneven thermal expansion of the shroud segments 28 and thereby causes the intersegment gaps 29 to close uniformly in operating conditions.

The present method has the advantage of not adding extra hardware or complexity into the engine. It is also inexpensive as this operation is typically done by wire-EDM, which is not a cost driver for shroud segments.

As mentioned hereinbefore, the shroud segments 28 of a gas turbine engine will always be hotter on the gas path upstream side and gradually cooler away from it, resulting in larger intersegment gaps 29 at the downstream side of the segments 28. The intersegment gaps 29 are machined wider near the gas path (i.e. on the upstream side thereof) and thinner near the downstream side to better control leakage.

It is also understood that the present invention can be applied to any temperature distribution, as opposed to the above-discussed example where the temperature distribution is linear from one end of the segments to the other. For instance, for a parabolic temperature distribution during normal cruise engine operation, one end of the segments could be machined with a bowed profile instead of a straight line in order to obtain the same result, i.e. an intersegment gap that closes uniformly at operating temperatures (see FIG. 6). With this concept, all temperature profiles can be captured, simple or complex.

Once the temperature distribution profile of the segments along the confronting faces thereof under engine operating conditions is established, then preferably one end of the segments may be provided appropriately in accordance with this temperature distribution profile in order to provide for a more-uniform closing of the intersegment gap during engine operation. Both ends of the segments may be profiled according to the present invention, if desired.

Figure 5:
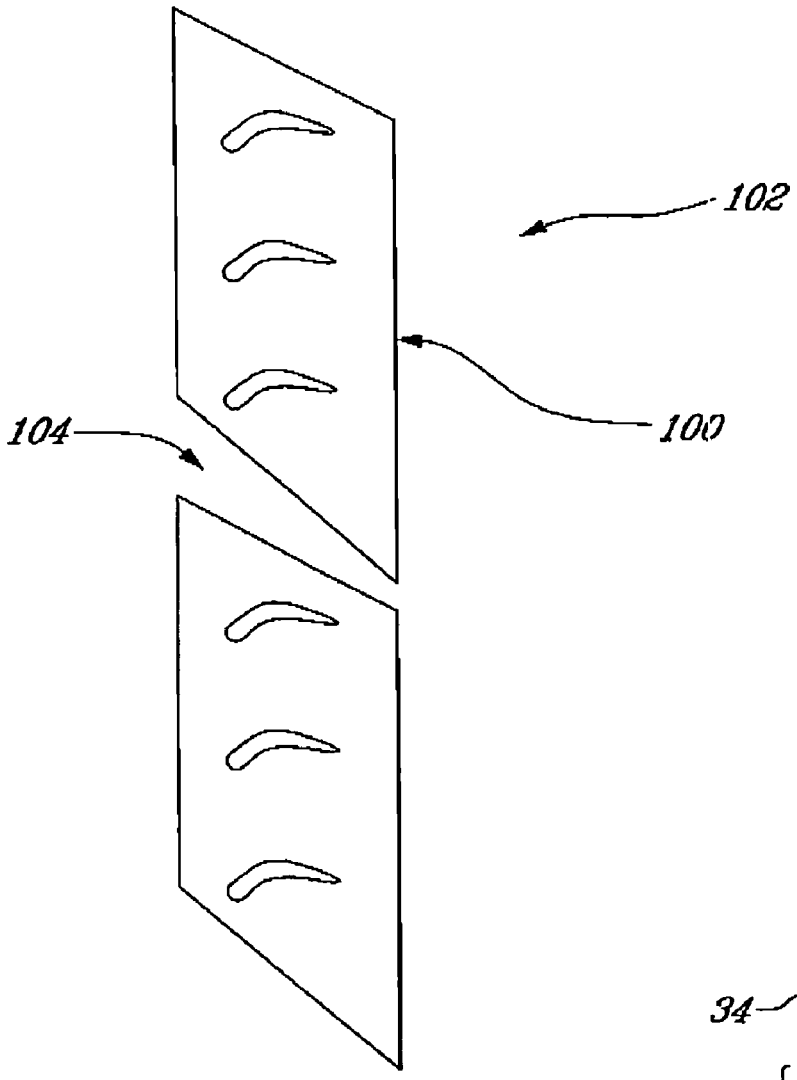
FIG. 5 is a simplified enlarged top view of a vane segment according to the present invention.

Finally, it is pointed out that the same principle can be applied to compensate for the radial temperature distribution across the segments. Furthermore, as shown in FIG. 5, it could be applied on other types of parts, such as vane segment platforms where the intersegment leakage is also important, and may be used with feather or other seals to further reduce leakage. As will be understood by the skilled reader and as depicted in FIG. 5, neither end need be a right angle at room or operating temperature as depicted in FIG. 4*a*–4*b*.

The embodiments of the invention described above are intended to be exemplary. Those skilled in the art will therefore appreciate that the forgoing description is illustrative only, and that various alternatives and modifications can be devised without departing from the spirit of the present invention. For example the profiled surfaces of the present invention may be provided on one or more mating surfaces of the present invention and the mating surfaces need not be linear or continuous, but may be non-linear and/or have step changes or other discontinuities. Also, it is to be understood that the segments need not be cut or machined but may be provided in any suitable manner. The term "room temperature" is used in this application to refer to a non-operating temperature, such temperature being below a relevant operating temperature of the engine. Accordingly, the present application contemplates all such alternatives, modifications and variances.

The invention claimed is:

1. In a gas turbine engine comprising an expansion joint to allow for thermal growth, the expansion joint comprising lint and second members having confronting faces defining a gap therebetween, wherein, at room temperature, the gap varies from one end of the faces to another end thereof in accordance with a temperature distribution profile of the first and second members during normal engine operation.

2. An expansion joint as defined in claim 1, wherein said confronting faces are non-parallel at room temperature.

3. An expansion joint as defined in claim 2, wherein said confronting faces are substantially parallel at operating temperatures of the gas turbine engine.

4. An expansion joint as defined in claim 1, wherein, at room temperature, said gap is wider at a location subject to a higher operating temperature during normal engine operation than at a location subject to a lower operating temperature during normal engine operation.

5. An expansion joint as defined in claim 4, wherein one of said first and second members is cut slantwise at one end thereof to form one af said confronting faces.

6. An expansion joint as defined in claim 1, wherein said first and second members respectively include first and second adjacent shroud segments of an annular shroud extending about an array of turbine blades, said gap being an intersegment gap.

7. In a gas turbine engine comprising an expansion joint having first and second members, the first and second members being provided with confronting faces defining a gap, which, at worn temperature, varies from one end to another as a function of a temperature gradient of said members under engine operating conditions, wherein said gap is substantially uniform when said first and second members are subject to said engine operating conditions.

8. An expansion joint as defined in claim 7, wherein, at room temperature, said gap is wider at a location subject to a higher operating temperature during normal engine operation than at a location subject to a lower operating temperature during normal engine operation.

9. An expansion joint as defined in claim 8, wherein one of said first and second members is cut slantwise at one end thereof in order to form one of said confronting faces.

10. An expansion joint as defined in claim 7, wherein said confronting faces are non-parallel at room temperature.

11. An expansion joint as defined in claim 10, wherein said confronting faces are substantially parallel at operating temperatures of the gas turbine engine.

12. An expansion joint as defined in claim 7, wherein said first and second members respectively include first and second adjacent shroud segments of an annular shroud extending about an array of turbine blades, said gap being an intersegment gap.

13. An annular shroud adapted to surround an array of turbine blades of a gas turbine engine, the shroud including a plurality of segments, each pair of adjacent segments having confronting faces defining an intersegment gap therebetween, said intersegment gap, at room temperature, varying along a length thereof according to a temperature profile of the segments during normal engine operating conditions.

14. An annular shroud as defined in claim 13, wherein said confronting faces are non-parallel at room temperature.

15. An annular shroud as defined in claim 14, wherein said confronting faces are substantially parallel at operating temperatures of the gas turbine engine.

16. An expansion joint as defined in claim 13, wherein, at room temperature, said gap is wider at a location subject to a higher operating temperature during normal engine operation than at a location subject to a lower operating temperature during normal engine operation.

17. An annular shroud as defined in claim 13, wherein each of said segments is cut slantwise at one end thereof to form one of said confronting faces.

18. A method for controlling leakage of fluid between first and second gas turbine engine members subject to non-uniform thermal growth during engine operation, the first and second members having adjacent ends defining a gap therebetween, the adjacent ends and gap having a width, the adjacent ends in use having an operating temperature which varies across the width of the ends, the method comprising the steps of: a) determining a temperature distribution profile of the expected operating temperature along the width of the adjacent ends during engine operation, and b) configuring at least one of the adjacent ends in accordance with the temperature distribution profile obtained in step a) to thereby promote more uniform sealing between the adjacent ends during engine operation.

19. A method as defined in claim 18, wherein step b) comprises the step of machining one of said adjacent ends along a path corresponding to the temperature distribution profile.

20. A method as defined in claim 19, wherein said temperature distribution profile is linear, and wherein said path extends slautwise along a straight line.

21. A method as defined in claim 19, wherein said temperature distribution profile is parabolic, and wherein said path extends along a parabolic curve.

22. A component for a turbine section of a gas turbine engine, the component comprising:

an annular segment portion, the annular segment portion being made of a material which predictably expands when heated, the annular segment portion having end faces adapted in oppose corresponding end faces of adjacent annular segment portions when the annular segment portion and adjacent annular segment portions are installed on the gas turbine engine, the annular segment portion and adjacent annular segment portions being exposed to a high operating temperature and an operating temperature differential along the end faces when the gas turbine engine is operated, the end faces of the annular segment portion being non-parallel to one another at room temperature, the end faces of the annular segment portion being adapted to become substantially parallel to one another by reason of thermal expansion when exposed to said operating temperature differential.

23. The component of claim 22 wherein the component is selected from the group of a turbine shroud and a turbine vane segment.

24. The component of claim 22 wherein the annular segment portion end faces are substantially planar at room temperature.

* * * * *

UNITED STATES PATENT AND TRADEMARK OFFICE

CERTIFICATE OF CORRECTION

PATENT NO. : 7,128,522 B2
APPLICATION NO. : 10/693961
DATED : October 31, 2006
INVENTOR(S) : Martin Jutras It is certified that error appears in the above-identified patent and that said Letters Patent is hereby corrected as shown below:

In the claims:

claim 1, column 4, line 58, delete “lint” and insert --first--
claim 7, column 5, line 17, delete “worn” and insert --room--

Signed and Sealed this

Thirtieth Day of January, 2007

JON W. DUDAS
*Director of the United States Patent and Trademark Office*